US005602632A

United States Patent [19]

Kuehnle

[11] Patent Number: 5,602,632

[45] Date of Patent: Feb. 11, 1997

[54] BELT APPLICATOR FOR DEVELOPING INK OR TONER ON A PRINT MEMBER

[75] Inventor: Manfred R. Kuehnle, New London, N.H.

[73] Assignee: Heidelberger Druckmaschinen AG, Heidelberg, Germany

[21] Appl. No.: 560,772

[22] Filed: Nov. 21, 1995

[51] Int. Cl.[6] ..... G03G 15/08; G03G 15/10

[52] U.S. Cl. ..... 399/265

[58] Field of Search ..... 355/259; 118/653; 101/330, 350, 367

[56] References Cited

U.S. PATENT DOCUMENTS 3,689,933 9/1972 Klose ..... 347/132

5,315,061 5/1994 Suzuki et al. ..... 118/651

FOREIGN PATENT DOCUMENTS

0141663A2 11/1984 European Pat. Off. .

*Primary Examiner*—Arthur T. Grimley
*Assistant Examiner*—Quana Grainger
*Attorney, Agent, or Firm*—Kenyon & Kenyon

[57] ABSTRACT

An ink applicator or donor is provided in which a belt tracks the surface of a prim member over a defined distance of the print member. A geometric conformance device is located inside the belt to ensure that the belt is equidistantly spaced apart from the print member surface.

17 Claims, 2 Drawing Sheets

BELT APPLICATOR FOR DEVELOPING INK OR TONER ON A PRINT MEMBER

FIELD OF THE INVENTION

The invention relates to ink or toner applicators for developing an image on a print cylinder.

BACKGROUND OF THE INVENTION

Developing or donor rollers for printers are well known, these rollers often being electrostatically charged to carry charged ink toner from a toner supply to a print cylinder. A latent electrostatic image carried on the print cylinder then attracts the toner from the donor roll onto the print cylinder. The image is thereby developed on the print cylinder.

For example, U.S. Pat. No. 5,315,061 to Suzuki et al. shows a developing roller having a conductive surface with dielectric bodies thereon. A charged toner is attracted to the roller by micro fields which arise between the dielectric bodies and the conductive surface. The toner then is transferred to a print belt which carries a latent image to be developed. A doctor blade can limit the thickness of the ink carried by the developing roller.

In prior art systems using a developing roller, such as the '061 patent, the developing roller only contacts the print member surface in a single location.

However, proper development of an image requires a certain minimum time for the latent image on the print surface to attract the necessary ink or toner. By contacting only a single location of the print surface, the developing rollers of the prior art are limited by the time necessary to develop properly the image on the print surface.

The developing roll prior art devices thus limit the speed and quality of the developed image, since the quality of the developed image, the narrowness and repeatability of its various tolerances, the insensitivity to ambient conditions during development, and the brevity of time or "speed" with which development can be accomplished depend largely on the nature of the ink applicator and its interaction with the print member.

U.S. Pat. No. 3,689,933 shows a developing station which covers a larger area of a print cylinder surface than a developing roller. However, the specifics of the developing station, including its reliability and quality, are not described.

European Patent Application 0141 663 shows a donor roller contacting a print surface at a single tangential point of a print cylinder. It also describes that an endless belt may be substituted for the donor roller, although this belt as well presumably would only contact the print cylinder at one point.

SUMMARY OF THE INVENTION

An object of the present invention is to provide an ink applicator which permits high quality development of an image on a print member. Another object is to allow increased printer speeds. A further object is to permit proper amounts of ink or toner to be transferred to the print member.

The present invention therefore provides an ink applicator in the form of an endless moving belt moving along a path, a portion of the belt path being configured to conform to the surface of a print member, such as a print cylinder. Another part of the belt path permits the belt to contact an ink reservoir, so that ink is picked up by the belt and transferred to the print cylinder. A geometric conformance device preferably operating by vacuum is provided inside of the belt so that the belt conforms to the surface of the print member.

The belt surface preferably is equipped with a pattern of pairs of parallel electrodes whereby each pair is maintained by voltages of opposite sign. The E-fields which extend from one electrode to the other are able to attract particles and build up an ink supply on the belt surface, either by attracting charged particles or, if the ink is uncharged, through dipole forces which attract the ink to the fields. The belt may have other configurations to attract particles, including a homogeneous charged surface or a charged surface with dielectric members thereon.

The ultimate thickness of the ink may be controlled by a doctor blade located next to the belt path between the ink applicator and the print member. With the belt being able to attract particle deposits of several hundred Angstrom thickness, and, preferably, the doctor blade shaving off the top, the latent electrostatic image on the print cylinder may be developed.

Preferably, a constant gap between the ink applicator belt and the print member surface exists, which gap then becomes saturated with ink.

The belt surface and the print member surface move at approximately the same speed. However, a belt drive mechanism is also provided so that the belt can be rotated at a speed independent of the print member speed. The belt then can move slightly faster (or slower) than the print surface. This relative movement between the belt and the print surface can enhance development and reduce fogging and ink particle clustering.

The ink applicator described preferably is used to apply a stationary colloidal matrix ink (CMI). However, the design features allow the ink applicator to also be used for powder toners, mud toners, and liquid toners.

BRIEF DESCRIPTION OF THE DRAWINGS

The present invention will be better understood in light of the following drawings, in which.

DETAILED DESCRIPTION

Figure 1:
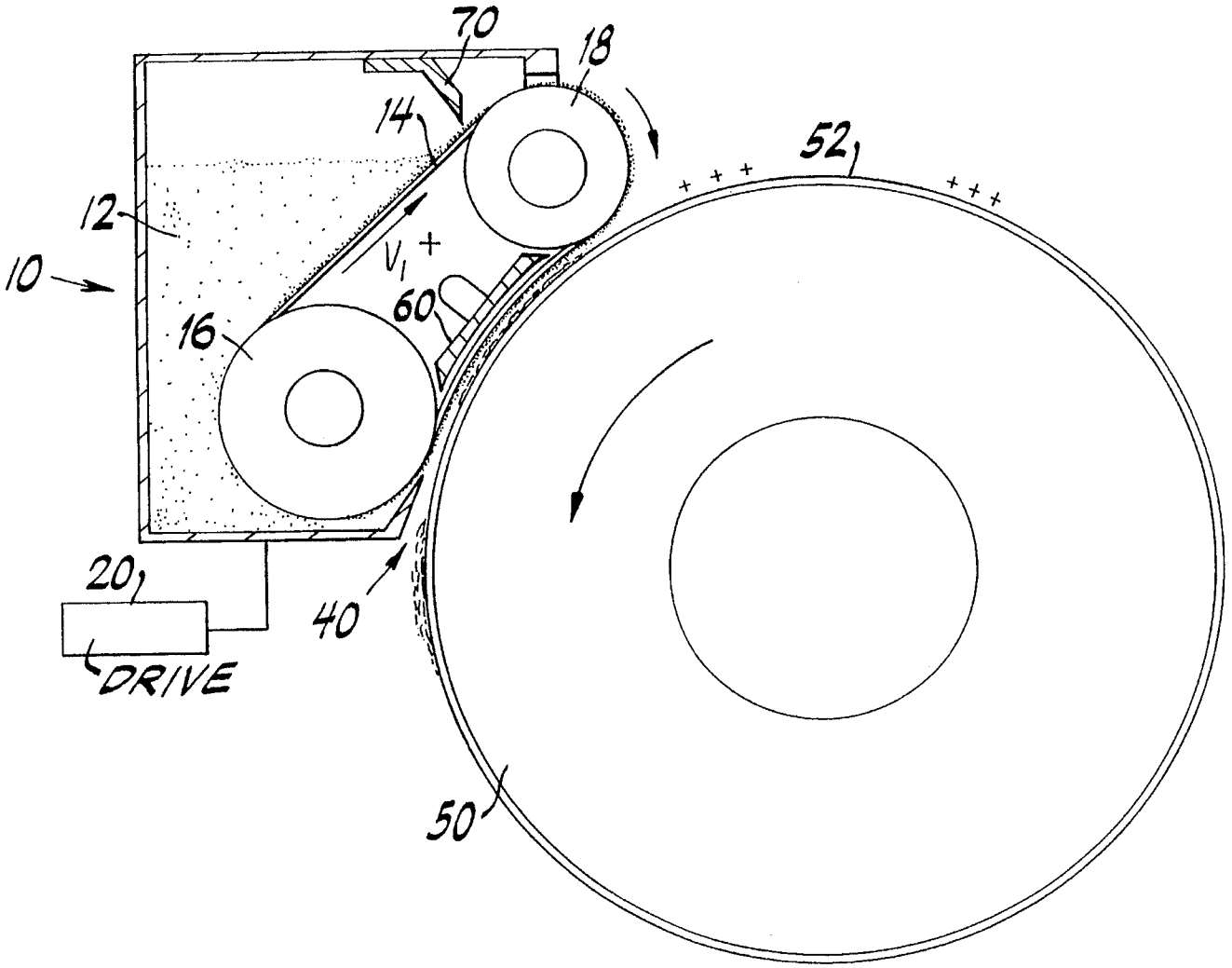
FIG. 1 shows a side view of an ink applicator according to the present invention, used in conjunction with a print cylinder.

FIG. 1 shows an ink applicator 10 having an ink supply or reservoir 12 for supplying ink to an endless belt 14 of the ink applicator 10. The belt 14 is spaced apart from a print cylinder 50 having a print cylinder outer surface 52, so that a gap 40 is formed between the belt 14 and outer surface 52 over a defined arc of the outer surface 52. The print cylinder 50 carries electrostatic charges representing a latent image on its outer surface written by a print head, for example the print head described in U.S. Pat. No. 5,325,120, which is hereby incorporated by reference.

The belt path tracks the outer surface 52 of the print cylinder 50, preferably at a uniform distance, through use of a geometric conformance device 60. The conformance device 60 acts on the inner surface of the belt 14 to alter the path of the belt 14 to conform to the contour of the outer surface 52. The conformance device 60 preferably uses a vacuum or suction force on the inside of the belt to alter the belt path. However, an electrostatic or magnetic force also could be used. The conformance device 60 preferably has a concave surface, as shown, along which the vacuum force operates in a uniform manner so as to alter the path of the belt 14.

The belt 14 is held rotatively by cylinder 16 and cylinder 18, although more cylinders could be used to have, for example, a triangular configuration of the belt 14. The cylinder 16 functions as a drive cylinder and is driven by a belt drive mechanism 20, shown schematically. However, any or more than one of the cylinders can be driven. The belt drive mechanism may also be the same mechanism which drives the print member. The belt drive mechanism 20 can rotate the belt 14 at a speed independent of the speed of the print cylinder 50, so that the belt 14 moves slightly faster than (or equal to, or less than) the speed of the print cylinder outer surface 52.

A doctor blade 70 is provided on the outside of the belt 14 for limiting the thickness of the ink attracted by the belt 14 at the ink reservoir 12 before the belt 14 enters the development gap 40.

Figure 2:
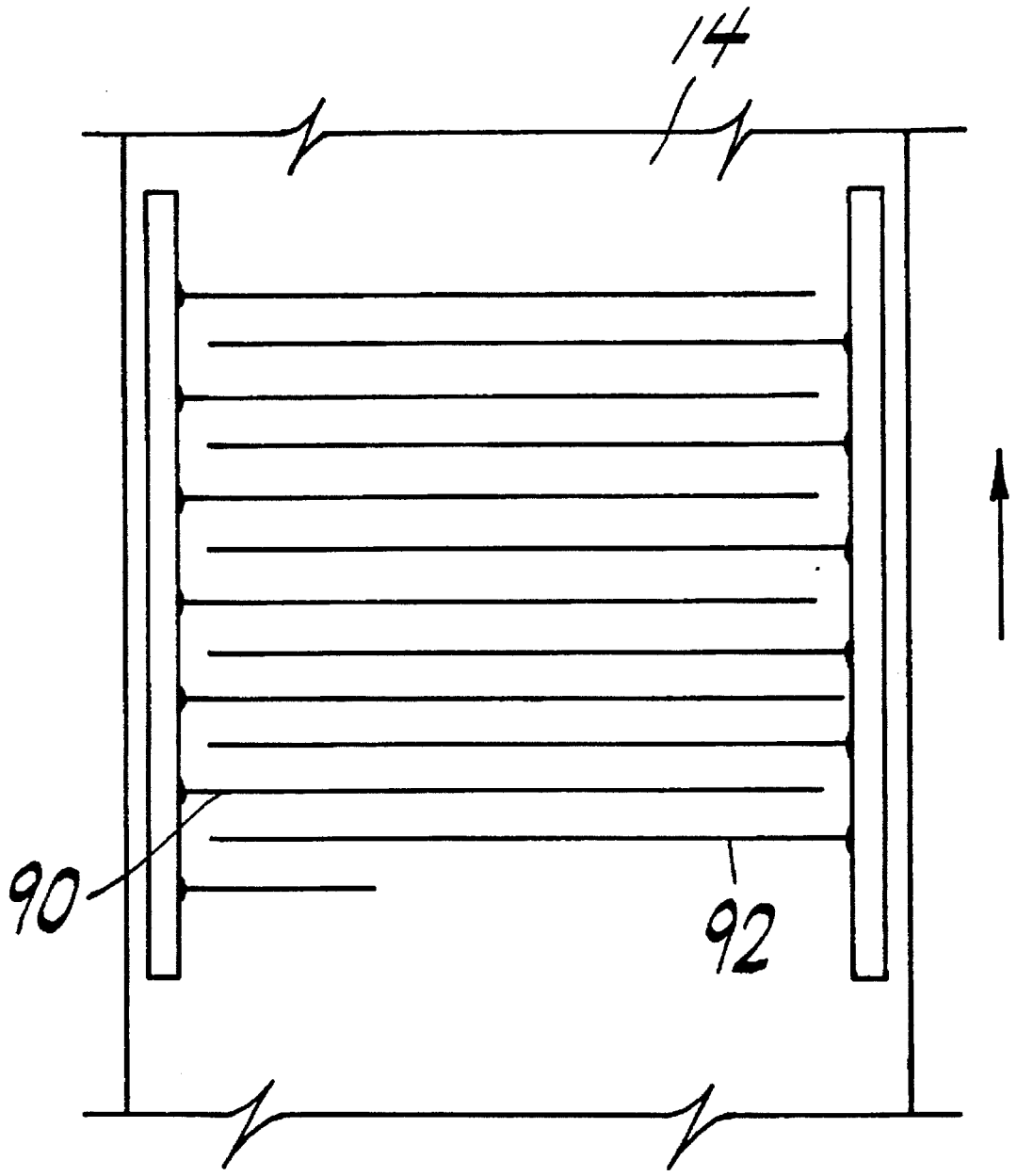
FIG. 2 shows one embodiment of the belt of the ink applicator in which charged lines are used to attract ink.

FIG. 2 shows the outer surface of the belt 14 having a set of negatively charged electrode fingers 90 and a set of positively charged electrode fingers 92, the fingers 90 and 92 extending generally parallel to one another and spaced apart from one another. The outer surface of the belt in which the wires may be embedded or placed on is made of a suitable elastic and insulating material, for example "Kaptel" polyester or Hydrel. A DC voltage source can charge these fingers to the desired voltages.

The backside of the belt may be metallic, if an electrostatic belt conformance device is used. The metallic layer thus permits electrostatic attraction. However, the electrical field conditions in the gap may be altered because of the presence of the metallic layer and electrostatic conformance device. To reduce this effect when the development gap is filled with ink, it is possible to electrically connect the back side of the belt and a conductive layer in the print cylinder can be to enhance the latent image fields and draw the field lines across the development gap.

In the above diagrams, the forces in the development gap 40 which hold the ink particles to the applicator belt 14 become progressively weaker in the direction of the print cylinder outer surface 52. And the electrostatic field forces which emanate from the latent image on the outer surface 52 become weaker in the direction of the belt 14. These forces determine the particle deposition height, e.g., the thickness of the particle layer, because the holding force increases either towards the belt or towards the latent image.

Preferably, the belt holds the ink particles either by a dipole force which becomes progressively weaker as the layer gets thicker, or it relies on charged particles which are attracted to the latent image until charge neutralization is achieved.

To have available sufficient "time" for producing a fully developed, stable image on the electrostatic image site, the ink applicator belt preferably may travel along the writing surface for about 30–50 milliseconds, although longer or shorter development times may be desirable depending on factors such as type of ink used, print speed and desired print quality.

The ink applicator may function with all types of ink, including CMI ink, charged particles, mud toners, and thin film.

To maintain the looseness of the particle supply, AC voltages rather than DC voltages may be supplied to the electrode fingers or the belt, thus constantly reversing the direction of the E-field between the fingers. The particles therefore are maintained in microscopic motion on the belt contacting the writing surface as a loose assembly from which individual particles are easily removed by slightly more powerful electrostatic attraction forces.

The direction of motion of the belt may also be changed by mechanical means such as a variable geometry roller.

To brush off unused particles before the belt recontacts the ink supply reservoir, a suction device or brush may be used. With the suction device the sucked off particles can be reentered into the ink reservoir.

What is claimed is:

1. An apparatus for developing ink on a surface of a prim member comprising:

an ink source;

an endless belt for receiving ink from the ink source; a portion of the belt interacting with the print member surface;

a belt drive connected to the belt; and a geometric conformance device located near the belt to move the belt away from the print member surface.

2. The apparatus recited as in claim 1 wherein the belt portion interacting with the print member surface is spaced equidistantly from the print member surface.

3. The apparatus as recited in claim 1 wherein the print member is cylindrical.

4. The apparatus as recited in claim 1 wherein the geometric conformance device is located inside the belt.

5. The apparatus as recited in claim 1 wherein the geometric conformance device further comprises a vacuum.

6. The apparatus as recited in claim 1 wherein the geometric conformance device further comprises an electrostatic charge device and the belt has a metallic backing.

7. The apparatus as recited in claim 1 wherein the belt has an outer surface which is charged.

8. The apparatus as recited in claim 1 wherein the belt has an outer surface having areas of differing conductivity.

9. The apparatus as recited in claim 1, wherein the belt has an outer surface having charged conductive fingers.

10. An apparatus for developing ink on a surface of a print member comprising:

an ink source;

an endless belt for receiving ink from the ink source, a portion of the belt spaced equidistantly from the print member surface at more than a single tangential location;

a belt drive connected to the belt; and a geometric conformance device located next to the belt.

11. The apparatus as recited in claim 10 wherein the geometric Conformance device is located inside the belt.

12. The apparatus as recited in claim 10 wherein the geometric conformance device operates by vacuum.

13. The apparatus as recited in claim 10 wherein the belt has a metallic backing.

14. The apparatus as recited in claim 10 wherein the print member is cylindrical.

15. The apparatus as recited in claim 10 wherein an outer surface of the belt is charged.

16. An apparatus for developing ink on a surface of a print member comprising:

an ink source;

an endless belt for receiving ink from the ink source, a portion of the belt spaced equidistantly from the print member surface at more than a single tangential location; and a belt drive connected to the belt, the belt having an outer surface having areas of differing conductivity.

17. An apparatus for developing ink on a surface of a print member comprising:

an ink source;

an endless belt for receiving ink from the ink source, a portion of the belt spaced equidistantly from the print member surface at more than a single tangential location; and a belt drive connected to the belt, the belt having an outer surface having charged conductive fingers.

* * * * *